US008042446B2

(12) United States Patent
Fujiwara et al.

(10) Patent No.: US 8,042,446 B2
(45) Date of Patent: Oct. 25, 2011

(54) PRESSURE-RESISTANT VESSEL AND BLASTING FACILITY HAVING THE SAME

(75) Inventors: Shuzo Fujiwara, Tsukuba (JP); Takehiro Matsunaga, Tsukuba (JP); Kiyoshi Asahina, Kobe (JP); Kenji Tamai, Kobe (JP); Kenji Koide, Kobe (JP); Katsuo Kurose, Kobe (JP)

(73) Assignees: National Institute of Advanced Industrial Science and Technology, Tokyo (JP); Kabushiki Kaisha Kobe Seiko Sho, Kobe-shi (JP)

( * ) Notice: Subject to any disclaimer, the term of this patent is extended or adjusted under 35 U.S.C. 154(b) by 177 days.

(21) Appl. No.: 11/910,744

(22) PCT Filed: Mar. 6, 2006

(86) PCT No.: PCT/JP2006/304253

§ 371 (c)(1),
(2), (4) Date: Oct. 5, 2007

(87) PCT Pub. No.: WO2006/112181

PCT Pub. Date: Oct. 26, 2006

(65) Prior Publication Data

US 2009/0095146 A1 Apr. 16, 2009

(30) Foreign Application Priority Data

Apr. 8, 2005 (JP) ..... 2005-112420

(51) Int. Cl.
*F42B 33/00* (2006.01)

(52) U.S. Cl. ..... 86/50; 73/35.17

(58) Field of Classification Search ..... 86/50; 73/35.17
See application file for complete search history.

(56) References Cited

U.S. PATENT DOCUMENTS 2,165,935 A * 7/1939 Menzel ..... 422/307
3,268,107 A 8/1966 Sperling
3,820,435 A * 6/1974 Rogers et al. ..... 89/1.1
3,982,134 A * 9/1976 Housholder et al. ..... 250/506.1
4,055,247 A * 10/1977 Benedick et al. ..... 206/3

(Continued)

FOREIGN PATENT DOCUMENTS

EP 1 718 922 A 11/2006

(Continued)

OTHER PUBLICATIONS

A.K. Krainev, "Machine Mechanics", Reference Book, M., Machinebuilding, 2000, p. 236.

(Continued)

*Primary Examiner* — Michael Carone
*Assistant Examiner* — Daniel Troy
(74) *Attorney, Agent, or Firm* — Oblon, Spivak, McClelland, Maier & Neustadt, L.L.P.

(57) ABSTRACT

An object of the present invention is to improve durability of a pressure vessel for blasting an article to be treated such as hazardous substance or explosive therein. The pressure vessel 10, means for achieving the object, has an external vessel 31 and an internal vessel 32 installed in the external vessel 31. The external vessel 31 has a strength for retaining pressure caused by blasting the article. The internal vessel 32 receives fragments of the treated article 100 to protect the external vessel 31 against the fragments. The internal vessel 32 preferably covers almost entire internal surface of the external vessel 31.

5 Claims, 2 Drawing Sheets

U.S. PATENT DOCUMENTS

| | | | | |
|---|---|---|---|---|
| 5,613,453 | A | 3/1997 | Donovan | |
| 5,884,569 | A | 3/1999 | Donovan | |
| RE36,912 | E | 10/2000 | Donovan | |
| 6,173,662 | B1 | 1/2001 | Donovan | |
| 6,299,950 | B1 * | 10/2001 | Byington et al. | 428/34.5 |
| 6,354,181 | B1 | 3/2002 | Donovan | |
| 6,647,851 | B2 | 11/2003 | Donovan | |
| 2003/0209133 | A1 | 11/2003 | Greenfield et al. | |
| 2005/0192472 | A1 | 9/2005 | Quimby et al. | |

FOREIGN PATENT DOCUMENTS

| | | | |
|---|---|---|---|
| EP | 1 761 737 | A | 3/2007 |
| JP | 05 045100 | | 2/1993 |
| JP | 07 128000 | | 5/1995 |
| JP | 07 208899 | | 8/1995 |
| JP | 7-208900 | | 8/1995 |
| JP | 2004 053063 | | 2/2004 |
| RU | 2 087 848 | C1 | 8/1997 |
| RU | 2 224 976 | C1 | 2/2004 |
| WO | WO 2005/085746 | A1 | 9/2005 |
| WO | WO 2005/090896 | A1 | 9/2005 |

OTHER PUBLICATIONS

Great Russian Reference Book, Third Edition, v.6, M., Publishing House, "Soviet Encyclopedia", 1971, p. 420.

* cited by examiner

PRESSURE-RESISTANT VESSEL AND BLASTING FACILITY HAVING THE SAME

TECHNICAL FIELD

The present invention relates to a pressure vessel in which a hazardous substance or an explosive is blasted and also to a blasting facility having the same.

BACKGROUND ART

There is known a military munitions including a steel shell filled with burster and chemical agent hazardous to the body, used for chemical weapons and others (e.g., projectile, mortar, bomb, land mine, and naval mine). Examples of the chemical agents include mustard and lewisite, which are hazardous to the body.

As a method for processing (e.g., detoxifying) such chemical weapons and hazardous substances such as organic halogen compounds, blasting disposal has been known. The blasting disposal of military munitions, which requires no disassembling operation, has advantages of adaptability to a disposal not only of favorably preserved munitions but also of munitions hard to disassemble because of its deterioration and deformation, and of decomposing capability of most of the chemical agents therein under the ultrahigh temperature and ultrahigh pressure generated by detonation. Such a method is disclosed in Patent Document 1, for example.

The blasting disposal is frequently performed within a tightly sealed vessel to prevent the chemical agents from leaking to outside and to reduce adverse effects on environment such as noise and vibration due to blasting. Furthermore, it can ensure the prevention of the outward leakage of the chemical agents to perform the blasting disposal within the vacuumed pressure vessel and keep the negative pressure in the vessel even after blasting.

Patent Document 1: Japanese Unexamined Patent Publication No. 7-208899

DISCLOSURE OF THE INVENTION

In the blasting method described in the Patent Document 1, used is the vessel rigid enough to prevent noise and withstand the impact by explosion. However, blasting of munitions for example scatters solid fragments of the shell of weapon and the like at a significantly high velocity by explosion in the vessel and the fragments collide with the internal wall of the vessel, often causing damages on the internal wall. Similarly, blasting of a hazardous substance other than munitions make fragments of a container of the hazardous substance collide with the internal wall of the vessel at significantly high speed. That causes damages such as scratches and dents to the vessel in a smaller number of treatments, thus imposing need for early exchange of the vessel. In addition, the pressure vessel, which is large in size and weight, demands significant labor and cost for its exchange.

Recently, the Japanese Government ratified the Chemical Weapons Convention and has an obligation under the convention to destroy chemical weapons left in China by the former Japanese Army. According to the "Outline of the Project for the Destruction of Chemical Weapons abandoned by the former Japanese army" issued in October 2002 by the Abandoned Chemical Weapons Office, Cabinet Office, there are estimated, approximately 700,000 chemical weapons still abandoned in all areas of China. In designing the processing facility, the report says that a facility should have a processing capacity of 120 munitions per hour, assuming that 700,000 munitions are processed in three years.

Accordingly, for efficient low-cost disposal of many abandoned chemical weapons by blasting the munitions described above, there is a strong demand for a method of blasting munitions in a vessel with lower damage which can reduce labor and time to exchange the vessel.

The present invention, which was made to solve the problems above, relates to a pressure vessel for blasting an article to be treated such as hazardous substance or explosives therein. The pressure vessel includes an external vessel having a strength for retaining pressure caused by blasting the article, and an internal vessel installed within the external vessel for receiving fragments of the article to protect the external vessel against the fragments.

In the pressure vessel, the external vessel retains the pressure, similarly to common pressure vessels, while the internal vessel installed therein receives fragments of munitions shell or containers scattered at high speed by blasting, thus the internal vessel protecting the external vessel against the fragments to prevent damage of the external vessel due to collision of the fragments. Even when the internal vessel is damaged significantly, there is no need for exchanging the external vessel which is massive and has a high-strength to retain the pressure, because the external vessel is protected by the internal vessel. In other words, exchange of the entire pressure vessel is not required, and it is required for resumption of blasting only to exchange the internal vessel leaving the external vessel unchanged. This allows the durability of the external vessel for retaining the pressure to be improved significantly.

The present invention also relates to a blasting facility comprising the pressure vessel.

The present invention can provide a blasting facility including a pressure vessel superior in resistance to pressure and having low running cost.

BEST MODE EMBODIMENT FOR CARRYING OUT THE INVENTION

Hereinafter, a favorable embodiment of a blasting facility according to the invention will be described with reference to drawings.

Figure 3:
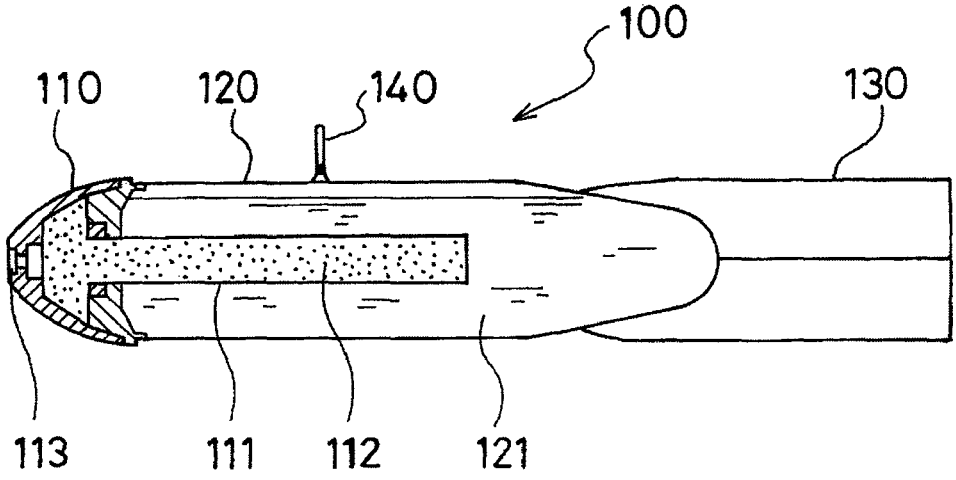
FIG. 3 is a cross-sectional view of a chemical bomb processed in the blasting facility.

First, a chemical bomb (chemical weapon), an example of the article to be blasted in the blasting facility in the present embodiment, will be described with reference to FIG. 3. FIG. 3 is a schematic sectional view showing a configuration of the chemical bomb.

There is shown a chemical bomb (explosive) 100 in FIG. 3. The chemical bomb 100 has a nose 110, a burster tube 111, a bomb shell 120, and an attitude-controlling fins 130.

The burster tube 111, extending backward from the nose 110, contains a burster (explosive) 112. The nose 110 is provided therein with a fuse 113 for bursting the burster 112 in the burster tube 111.

The bomb shell 120 is connected to the nose 110, while containing the burster tube 111 therein. The bomb shell 120 is filled with a liquid chemical agent (hazardous substance) 121.

The attitude-controlling fins 130, which is placed at an end position opposite to the nose 110 in the axial direction of the bomb shell 120, controls an attitude of the dropped chemical bomb 100.

The top of the bomb shell 120 is provided with a hoist ring 140 to hoist the chemical bomb 100 and load it on an airplane.

An object to be treated in the present embodiment is all or part of the chemical bomb 100 containing at least an explosive 112 and a chemical agent 121 as described above. The present invention is not limited to the chemical bomb 100 filled with the chemical agent 121 as described above, and is also applicable to blasting only a burster unit in the chemical bomb in the pressure vessel after disassembly of the chemical bomb.

Examples of the explosives blasted in the present invention include military explosives such as TNT, picric acid, and RDX, blister agents such as mustard and lewisite, vomiting agents such as DC and DA, and chemical agents such as phosgene, sarin, and hydrocyanic acid.

In addition, the blasting facility in the present embodiment may also be used in blasting not only the exemplified chemical bomb 100 above but also, for example, a hazardous substance such as organic halogen contained in containers.

Figure 1:
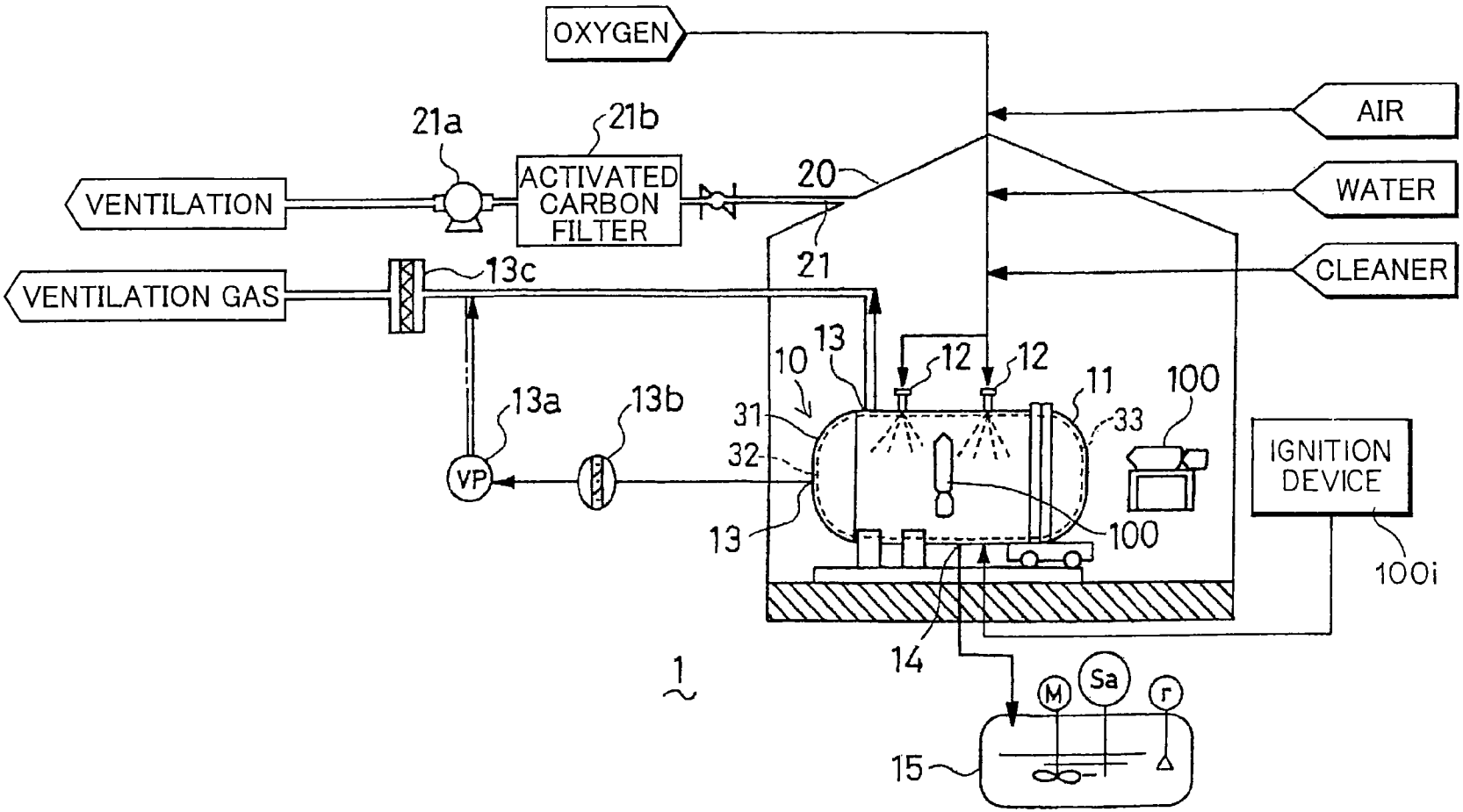
FIG. 1 is a diagram showing an entire configuration of a blasting facility in an embodiment of the present invention.

Hereinafter, there will be described an out door facility as an example of the facility for blasting the explosive such as the chemical bomb 100 described above, with reference to FIG. 1. FIG. 1 is a schematic view illustrating a configuration of the blasting facility.

The blasting facility 1 shown in FIG. 1 includes a pressure vessel 10 and a tent 20 for accommodating the pressure vessel 10 inside, as its main components.

The pressure vessel 10 has an explosion-proof construction of steel or the like, made rigid enough to withstand the blasting pressure during blasting the explosive device such as chemical bomb 100 inside. The pressure vessel 10 has a double-layered structure having an external vessel 31 and an internal vessel 32, and its detailed configuration will be described below.

The external vessel 31 of the pressure vessel 10 has a main body extending in the horizontal direction and a pressure-proof lid 11 removable from the main body at an end of the external vessel 31 in the length direction. The pressure-proof lid 11 can be removed from the main body to allow an explosive transported such as chemical bomb 100 to be introduced into the pressure vessel 10. A chemical bomb 100 or the like is introduced into the pressure vessel 10 thereby, and fixed in the pressure vessel 10 by a fixing means not shown in the Figure. Thereafter, the pressure-proof lid 11 is connected to the main body to make the pressure vessel 10 closed. In this state, the explosive is blasted. The top of the pressure vessel 10 is formed with a plurality of injection ports 12. These injection ports 12 are used for injection of oxygen into the pressure vessel 10 before blasting and for injection of air, water, cleaner and others into the pressure vessel 10 for decontamination operation after blasting.

In addition, there are formed two exhaust vents 13 on the top of the pressure vessel 10 and on the side wall opposite to the pressure-proof lid 11. The exhaust vents 13 are used to make the vessel under a reduced-pressure or vacuum state by ventilating air from inside the pressure vessel 10 through a filter 13*b* by using a vacuum pump 13*a* before blasting and to ventilate the vessel exhaust air such as vessel vent from inside the pressure vessel 10 through a filter 13*c* after blasting.

In addition, the bottom of the pressure vessel 10 is formed with a drainage port 14, through which waste water generated by decontamination operation is discharged into a processing tank 15.

There is placed an ignition device 100*i* outside the pressure vessel 10 to ignite the explosive device such as chemical bomb 100 fixed in the pressure vessel 10. The ignition device enables blasting by remote control.

A strong wall is preferably formed surrounding the pressure vessel 10 so that the tent 20 will be protected in case that the explosive such as the chemical bomb 100 happens to break the pressure vessel 10 down.

The tent 20 has a door not shown in the Figure, and the door is opened to allow the pressure vessel 10 and an explosive such as chemical bomb 100 to be transported into the tent 20. The tent 20 is provided with an exhaust vent 21, which is used for ventilation of the exhaust air from the tent 20 through a filter 21*b*, for example containing activated carbon, by using a blower 21*a*.

Thus, in the present embodiment, blasting disposal of the chemical bomb 100 is performed in the blasting facility 1 including at least the pressure vessel 10 above.

Figure 2:
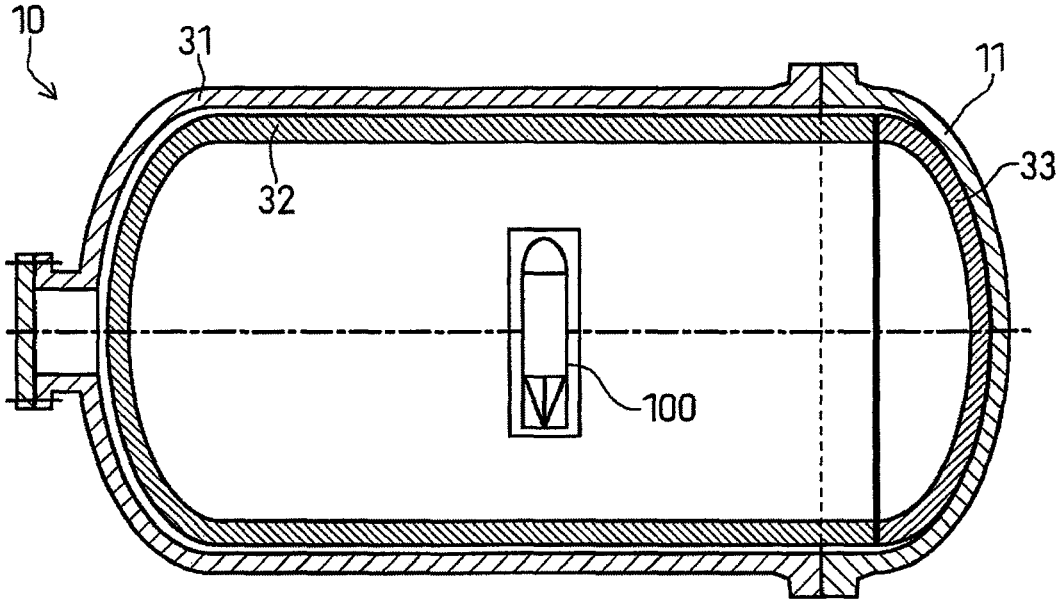
FIG. 2 is a cross-sectional view of a pressure vessel in the blasting facility.

Hereinafter, the configuration of the pressure vessel 10 will be described in detail with reference to FIG. 2. FIG. 2 is a schematic cross-sectional view illustrating the configuration of the pressure vessel 10.

The pressure vessel 10 shown in FIG. 2 comprises the external vessel 31 and the internal vessel 32 described above. The external vessel 31 is a strong pressure vessel, which is formed with steel etc. and has a strength sufficient to retain the pressure caused by explosion. The internal vessel 32 is made of strong material, such as steel, so as to withstand the collision with scattering fragments.

The external vessel 31 is cylindrically shaped with its one end in the axial direction closed and the other end open, and the pressure-proof lid 11 described above is connected detachably to the open end. The internal vessel 32 is also cylindrically shaped with its one end in the axial direction closed and the other end open, and is installed in the external vessel 31 so that the open other end is directed to the pressure-proof lid 11. The open other end of the internal vessel 32 is provided with an internal lid 33 detachably.

The internal vessel 32, being not tightly fixed to the external vessel 31, is installed within the external vessel 31 loosely. In other words, the internal vessel 32 is installed in the external vessel 31 in such a manner that the internal vessel 32 can move slightly, relatively to the external vessel 31. Such a loose installation of the internal vessel 32 prevents direct transmission of the shock by explosion and the collision with scattered fragments to the external vessel 31, and action of excessively large force to the connecting region (fixing region) between the internal vessel 32 and the external vessel 31, thus inhibiting damage in the connecting region. This improves the durability of the pressure vessel 10.

There may be various methods for installing the internal vessel 32 loosely in the external vessel 31. For example, the two vessels 31 and 32 may be interconnected with clearance therebetween in such a manner that the internal vessel 31 is slightly movable in the external vessel 32, or there may be provided a vibration absorber between the two vessels 31 and 32 where the vessels 31 and 32 are fastened to each other with a bolt and the like.

In the facility, the blasting disposal of the chemical bomb 100 is performed in the procedure of installing the chemical bomb 100 in the internal vessel 32 of the pressure vessel 10, attaching the internal lid 33 and the pressure-proof lid 11 to the vessels to close them, and blasting the chemical bomb 100 with a blasting device not shown in the Figure.

Blasting the chemical bomb 100 scatters metal fragments of the bomb shell of the chemical bomb 100 and the like at high speed, but the fragments collide only with the internal vessel 32 and the internal lid 33 to be received by them. While being damaged by the collision with the fragments, the internal vessel 32 and the internal lid 33 protect the external vessel 31 and the pressure-proof lid 11 against the fragments from inside. Accordingly, the external vessel 31 is not damaged even by repeated blasting.

To examine the advantages of the present invention, the inventors have 41 times blasted a simulated chemical bomb similar to the chemical bomb described above in its configuration and quantity in a pressure vessel 10 having an internal vessel 32 and external vessel 31, using a suitable amount of explosive, and then have observed the appearance of the internal vessel 32 and the external vessel 31. The results are summarized in Table 1.

TABLE 1

| REGION | DAMAGE DEPTH | DAMAGE NUMBER |
|---|---|---|
| INTERNAL SURFACE OF INTERNAL VESSEL | UP TO 3 mm | COUNTLESS |
| INTERNAL SURFACE OF EXTERNAL VESSEL | — | NONE |

As shown in the Table, the internal vessel 32 have had a countless number of damages, while the external vessel 31 have had no damage at all.

As described above, the pressure vessel 10 in the present embodiment has an external vessel 31 having a strength for retaining pressure caused by blasting therein and an internal vessel 32 for receiving fragments of the blasted article such as chemical bomb 100 to protect the external vessel 31 from damage; wherefore the external vessel 31 shows resistance to blasting pressure, similarly to common pressure vessels, while the internal vessel 32 protects the external vessel 31 by receiving the fragments of bomb shell or vessel scattered at high speed by blasting the article. Thereby, the external vessel 31 remains free of damage substantially even when the internal vessel 32 is damaged significantly. This makes it unnecessary to exchange the entire pressure vessel 10 including the high-strength, heavy and thick external vessel 31. To exchange only the damaged internal vessel 32 enables resumption of the treatment. Thus, the pressure vessel 10 can reduce the running cost of the blasting facility 1 more than conventional pressure vessels.

The internal vessel 32, differently from the external vessel 31, does not demand a strength for retaining the pressure caused by blasting (i.e., demands no explosion-proof structure). This allows a vessel having a simple structure lower in withstanding pressure than the external vessel 31 to be used as the internal vessel 32. Such simplification of the structure of the internal vessel 32 facilitates reduction of the running cost of the blasting facility 1.

In addition, a detachable connection of the internal vessel 32 to the external vessel 31 facilitates operation for exchanging the internal vessel 32.

The present invention includes an embodiment where the internal vessel 32 covers only a part of the internal surface of the external vessel 31. However, the pressure vessel 10 shown in FIGS. 1 and 2, having the internal vessel 32 which covers the almost entire internal surface of the external vessel 31, has higher damage-resistance and durability of the external vessel 31 than that of a vessel having an internal vessel 32 which covers only a part of the internal surface of an external vessel 31.

The present invention also includes an embodiment where the internal vessel 32 is tightly fixed to the external vessel 31. However, the loose installation of the internal vessel 32 to the external vessel 31 as described in the embodiment above suppresses direct transmission of the shock generated by explosion to the external vessel 31 and prevents action of excessively large force to the region connecting the internal vessel 32 and external vessel 31 to each other. This inhibits damage of the connecting region to improve the durability of the pressure vessel 10.

Better still, in the pressure vessel 10 of the embodiment above, the external vessel 31 has a pressure-proof lid 11 at an end in the longitudinal direction and the internal vessel 32 has an internal lid 33 at the side corresponding to the pressure-proof lid 11, thus the pressure-proof lid 11 and the internal lid 33 being placed in the same side. This facilitates operation for transporting the chemical bomb 100 into the pressure vessel 10 and for removing the fragments after blasting, thus shortening the time required for the operation.

Although the blasting facility in the embodiment above is installed outdoor, the present invention also includes a facility wherein a pressure vessel containing a tightly sealed explosive is buried in the ground to perform a blasting disposal therein.

The invention claimed is:

1. A pressure vessel for blasting an article to be treated within the pressure vessel, the pressure vessel comprising:

a pressure tight external vessel having a strength for retaining blasting pressure caused by blasting the article, wherein a blasting pressure caused by blasting the article is retained in the external vessel;

an internal vessel detachably installed within the external vessel for receiving fragments of the treated article to protect the external vessel against the fragments, wherein the internal vessel extends adjacent to substantially the entire internal surface of the external vessel; and an ignition device positioned to ignite the article to be treated within the pressure vessel, wherein the external vessel includes a pressure-proof lid, and the internal vessel includes an internal lid adjacent to the pressure-proof lid.

2. The pressure vessel according to claim 1, wherein the internal vessel is loosely installed within the external vessel.

3. A blasting facility comprising the pressure vessel according to claim 1.

4. The pressure vessel according to claim 1, further comprising a first injection port to inject oxygen into the pressure vessel before blasting the article.

5. The pressure vessel according to claim 4, further comprising a second injection port to inject at least one of air, water and into the pressure vessel after blasting the article.

* * * * *